US005289544A

United States Patent [19]

Franklin

[11] Patent Number: 5,289,544

[45] Date of Patent: Feb. 22, 1994

[54] METHOD AND APPARATUS FOR REDUCING BACKGROUND NOISE IN COMMUNICATION SYSTEMS AND FOR ENHANCING BINAURAL HEARING SYSTEMS FOR THE HEARING IMPAIRED

[75] Inventor: David Franklin, Somerville, Mass.

[73] Assignee: Audiological Engineering Corporation, Somerville, Mass.

[21] Appl. No.: 815,046

[22] Filed: Dec. 31, 1991

[51] Int. Cl.[5] ..... H04R 25/00

[52] U.S. Cl. ..... 381/68.1; 381/23.1; 381/68; 381/69; 381/111; 381/155; 381/163

[58] Field of Search ..... 381/23.1, 68, 68.1, 381/69, 111, 155, 163, 71

[56] References Cited

U.S. PATENT DOCUMENTS

| | | | |
|---|---|---|---|
| 3,632,902 | 1/1972 | Wahler | 381/68.1 |
| 4,051,330 | 9/1977 | Cole | 381/68.1 |
| 4,694,499 | 9/1987 | Bartlett | 381/155 |
| 4,768,614 | 9/1988 | Case | 381/91 |
| 4,904,078 | 2/1990 | Gorike | 381/68.1 |
| 4,965,775 | 10/1990 | Elko et al. | 381/92 |
| 5,046,102 | 9/1991 | Zwicker et al. | 381/68 |

OTHER PUBLICATIONS

Improvement of Speech Intelligibility in Noise, Wim Soede pp. 1-159 "Development and Evaluation of a New Directional Hearing Instrument Based on Array Technology".

*Primary Examiner*—John F. Peng
*Assistant Examiner*—Edward Lefkowitz

[57] ABSTRACT

Directional hearing in noisy environments is enhanced using small conventional microphones. In one embodiment a conventional first order bidirectional gradient microphone is employed in connection with a barrier to produce sound shadow at the rearward end of the microphone. In other embodiments such as hearing assistive devices worn on a person's head or body, the head or body of that person serves as the barrier. The result is a significant reduction in gain for all frequencies of acoustic energy emanating from generally rearward of the microphone. The sound shadow creates an apparent change of direction of arrival for rearwardly arriving acoustic energy, thereby making it appear to the microphone that the sound is approaching from the high attenuation 90° direction. Two spaced bidirectional microphones worn on a person's body may be positioned to take advantage of this effect while simulating binaural hearing in an assistive listening device. A similar directional result is obtained with two conventional cardioid microphones mounted on a common casing to face in opposite directions. Electronic circuitry subtracts the output signal of the rearward facing microphone from the output signal of the forward facing microphone to render the combination highly directional. Case noise and other mechanical vibrations modulating the two output signals are nulled out in the subtraction process.

29 Claims, 5 Drawing Sheets

(CARDIOID-FREE SPACE WIDEBAND NOISE)

(BI POLAR-FREE SPACE WIDEBAND NOISE)

(CARDIOID- CHEST MOUNTED WIDEBAND NOISE)

(BI POLAR- CHEST MOUNTED WIDEBAND NOISE)

(CARDIOID-CHEST MOUNTED NARROWBAND NOISE)

(BI POLAR-CHEST MOUNTED NARROWBAND NOISE)

(CARDIOID- HEAD MOUNTED WIDEBAND NOISE)

(BIPOLAR- HEAD MOUNTED WIDEBAND NOISE)

METHOD AND APPARATUS FOR REDUCING BACKGROUND NOISE IN COMMUNICATION SYSTEMS AND FOR ENHANCING BINAURAL HEARING SYSTEMS FOR THE HEARING IMPAIRED

This invention was made with government support under grant awarded by the National Institute of Health. The government has certain rights in the invention.

BACKGROUND OF THE INVENTION

1. Technical Field

The present invention relates generally to microphones and particularly to methods and apparatus for enhancing directional capabilities of microphone systems. The invention has particular utility in small microphone applications involving focused sound reception in noisy environments, such as hearing-assistive devices worn by hearing-impaired individuals, voice-controlled computers, and the like.

2. Discussion of the Prior Art

One aspect of the present invention relates to the use of first order bidirectional gradient microphones in communication applications where undesired background noise is present. Another aspect of the invention relates to the use of oppositely directed cardioid microphones mounted together for those same applications. Of particular interest are those applications where small size is required, as is the case for wearable devices for the hearing impaired, and for individuals working in noisy areas where noise reduction cups and wearable amplification systems are commonly used. Also of particular interest are applications such as speech responsive computer systems and applications wherein binaural aiding retains or enhances the ability to identify spatial location of sounds by virtue of different intensities appearing at each aided ear.

The microphone systems of the present invention are improvements over the first and second order unidirectional gradient microphones used in the prior art to obtain noise reduction and high forward gain. Although the goals of noise reduction and high forward gain are similar to the goals in using prior art directional microphone types (generally categorized as wave types, such as "shotgun" microphones, combination line and surface microphones, and combination line and cardioid arrays) to obtain high forward gain and noise reduction, the present invention permits realization of small wearable microphone systems as compared to prior art systems that are large and not generally applicable in situations where small size is a requirement.

The ability to comprehend speech and other desired sound signals in the presence of interfering noise signals is invariably degraded as compared to listening under quiet conditions. The degree of degradation is strongly influenced by the signal-to-noise ratio, by the spectral relationship between the desired and the interfering signals, and by the state of the listener's hearing apparatus. An individual with a damaged hearing system has a much more difficult task than an individual with normal hearing; however, in either case, as the signal-to-noise ratio becomes worse, so does comprehension. All attempts to help a listener under noisy ambient conditions must focus on two considerations. The first is the need to improve, by whatever means, the signal-to-noise ratio for the listener. The second, which is less apparent and not applicable in all situations, is the desirability of avoiding interference with the individual's binaural hearing. Several investigations have shown that binaural hearing improves comprehension under noisy conditions by almost 4 db, a significant amount. While in some situations the problem can be solved by placing a microphone nearer the message source, this is by no means possible in all cases. In the remaining cases, the major strategy is to usually employ some form of directional microphone. For wearable systems, including devices such as hearing aids and other body worn assistive listening systems, the size of the directional microphone is of great significance; because of this, in almost all cases, a type of microphone termed directional gradient is characteristically used.

Directional gradient microphones are a class of microphones that obtains directional properties by measuring the pressure gradient between two points in space. This is in contradistinction to omnidirectional microphones that measure a soundwave produced pressure change referenced to a closed volume of air and hence have no directional characteristics. For most modern directional pressure gradient microphones, the pressure differential across a single membrane is sensed, the membrane being used to divide a tube into two parts with both ends of the tube left open to receive the pressure signal from an external sound source. For this kind of geometry the pressure gradient appearing across the membrane is a combined function of the tube length on either side of the membrane, any acoustic phase-shifting mechanisms that may be included in either side of the tubing, and the direction of arrival of the sound pressure signal with respect to the orientation of the tube. The most common material used for the membrane in modern microphones is so-called "electret" film that responds to flexure by producing an electrical voltage across its two faces. Microphone assemblies employing one such element are referred to as "first order" microphones; assemblies employing two such elements are referred to as "second order" arrays; and so on. Higher order arrays are generally found to have greater directivity than lower order arrays, but also have other properties that may not be desirable. These include greater susceptibility to wind noise, greater susceptibility to case contact noise, greater bulk and sharper fall-off in gain at low frequencies. Regarding this last point, all first order directional microphones experience a gain decrease of 6 db per octave as the frequency lowers, second order directional microphones experience a 12 db per octave gain decrease as the frequency lowers, and so on.

Pressure gradient directional microphones of whatever order are further divided into two classes depending on whether they are: "unidirectional", having their greatest gain in one direction, usually taken to be along the 0°-axis as depicted in polar plots of microphone gain; or "bidirectional", having their greatest gain in two directions, usually taken to be along the 0°-axis and the 180°-axis. It is worthwhile noting that in neither case is the beam pattern only along the major axis; rather, all of these microphones receive some energy from all directions. However, the maximum reception of energy is along the axis directions as described above, and reception of energy is reduced in all other directions. As examples, the most common type of unidirectional microphone, the cardioid, has a gain of unity at 0°, −6 db at +/−90° and −20 db or less at 180°. In contrast, a symmetric bidirectional microphone has a gain of unity at 0° and 180°, a gain of −6 db at both +/−45° and +/−135°, and a gain of −20 db or less at +/−90°. From this information it is clear that while a unidirectional gradient microphone receives most of its energy from one direction, a bidirectional gradient microphone receives most of its energy from two directions 180° displaced from one another.

An important measure for predicting the performance of various microphone configurations in the presence of noise is the noise-to-signal response. In essence, this is the ratio between the response of the microphone to a uniform noise field and its response to a signal along the direction of its maximum response. For reference, this ratio is taken as unity for an omnidirectional microphone measured under the same conditions. Typical values of this parameter for pressure gradient directional microphones are: ⅓ for first order cardioid elements and 1/12 for second order pressure gradient arrays. A symmetric bidirectional first order pressure gradient microphone typically has a noise-to-signal ratio of about ⅓. In terms of improved signal to noise ratios, these amount to approximately 4.7 db for cardioids, approximately 10.8 db for second order gradient arrays and approximately 4.7 db for bidirectional first order arrays.

In view of the foregoing, it is not surprising that, in applications requiring noise reduction, the selection of microphone pattern is an important consideration. Generally, if circumstances permit, the higher order arrays are used to reduce background noise. In situations where size, cost or other factors limit the applicability of higher order arrays, unidirectional cardioid elements are selected over omnidirectional designs. Bidirectional arrays are seldom employed except in a few special cases. The major reason for not choosing bidirectional microphones is because undesired signals typically appear both in front of and behind the microphone, not merely off to the sides.

Factors included in microphone selection that might mitigate against the use of higher order arrays include: size (higher order arrays are larger than first order arrays); sensitivity to wind noise and case noise (any signals reaching the arrays and not meeting the necessary phase requirements result in large unwanted transient outputs); low output level at low frequencies (as noted previously, second order arrays have decreasing gain at −12 db/octave as frequency decreases); and increased complexity of the accompanying electronics.

In understanding the present invention it is important to appreciate the effects of sound-shadows as may be occasioned by the presence of an object between a microphone element and a given sound source. If the size of the object is larger than the wavelength of the frequencies contained in the sound signal, there is a significant decrease in the energy level arriving at the microphone element. This loss of energy can be very large and generally is more evident at high frequencies because low frequencies have longer wavelengths than high frequencies. For example, a 1000 Hz signal has a wavelength of about one foot while at 100 Hz the wavelength is about ten feet. For the case where the wavelength is long compared to the dimensions of the blocking object, diffraction around the object occurs, resulting in a phase shift of arriving signals but no effective attenuation. Hence, for a hearing aid with a microphone mounted in the ear, high frequency sounds arriving at the microphone site are attenuated if their wavelengths are shorter than the size of the wearer's intervening head, but lower frequencies with longer wavelengths will not be so attenuated. This factor is very important both from a functional point of view (sound directionality in either the aided or unaided ear is mainly determined by high frequency signals being differently attenuated at the two ears, and technically in the selection of an appropriate microphone type for various applications.

In many wearable microphone applications, such as in hearing aids, omnidirectional microphones are used instead of cardioid elements even though it would appear at first blush that the cardioid type would be a better selection since hearing impaired individuals have greater than normal problems with understanding speech in noisy environments. The major reasons for not selecting cardioid microphones, however are that: improvements in signal-to-noise ratio found in actual use are seldom as great as those predicted by laboratory measurement; increases in size and complexity of the hearing aid structure required by the use of cardioid microphones ar often not perceived to be justified by the potential gains in signal-to-noise ratios; and the beneficial effects of head shadow (blocking of sound) in improving signal-to-noise ratio make the realizable difference between the use of omnidirectional elements and cardioid elements very small, usually on the order of 2 db or less which is barely perceivable.

Since bidirectional elements receive as much signal from the rear as from the front (or nearly so, depending on design parameters), these microphone types are never used in wearable microphone applications. When all of the factors affecting noise reduction, including head shadow, are taken into account, the net effect of using bidirectional elements in hearing aids has been considered to be undesirable as compared to either omnidirectional or cardioid microphones. In particular, since most hearing aids are ear-level mounted, the orientation of bidirectional microphones is limited to having the microphone facing forward and backward, meaning that sound energy in the rear is as strongly received as sound energy from the front. It is evident that this is not a desirable mode of operation. Hence, the major application of bidirectional microphones is in controlled situations where it is possible to assure that no sound sources are along the 180° axis. An example of such a use is in a recording or broadcast studio where the location of all sound sources can be controlled.

A further use of directional microphones is in the control of computers where the controlling input signal is a closed vocabulary speech signal. The general method, sometimes referred to as a "speech mouse", is based on speech recognition where the user trains an interface to recognize his voice for a set of commands. A problem commonly encountered in these systems is that the typical office environment is noisy while the recognition circuits require a good signal-to-noise ratio in order to have error free responses. Clearly, the selection of a proper microphone is critical. A further limiting factor is that the cost of these voice response systems are modest, generally well under $1000, and the cost for the microphone must be kept correspondingly low. At present the choices made for the microphone pattern types are usually either cardioids or super-cardioids (both first order gradient types) or, in some cases, second order gradient types. The latter choice results in greater expense and more complicated electronics.

A further related background topic of interest in the use of microphones for communication purposes is how stereo binaural hearing is attained. Normal binaural hearing, with its spatial separation of sound events due to the manner in which sound signals arrive at the ears, permits a listener to distinguish among competing sound events. A major cue used by the human hearing system is the intensity of the sound at each ear. The head sound shadow, taken in conjunction with the location and shape of the external ear, results in considerable difference in sound intensities at the two ears depending on the orientation of the listener's head with respect to the arriving sound signal. For signals above about 1000 Hz, the difference in intensity can be as great as 10 db, depending on the angle of arrival. When binaural aided hearing is implemented in a hearing impaired person with ear-level hearing aids (e.g., behind the ear or in the ear), spatial separation of sound is retained because the microphones are located in the same positions as the ears. This is true, whether omnidirectional or unidirectional microphones are used, because of the effects of head shadow. When the microphones are located on the chest (as in body type hearing aids or in other so-called "assistive listening devices"), the stereo effects are lost even if two cardioid microphones are used. The reason for this is that the change in gain in cardioid microphones, as a function of angle of arrival of the sound signals, is too small to replicate the desirable effects of signal attenuation caused by head shadow. While second order or higher order directional microphones can provide these effects, they are too large, too prone to wind and case noise, have excessive loss of gain at low frequencies and require too complicated electronics to be practical. The result is that, for body type hearing aids and for body worn assistive listening devices, the stereo effect is lost. This is unfortunate because, in addition to a good signal-to-noise ratio, the ability to perceive the direction of arriving sound source is an important second factor in effective hearing in noisy situations. Binaurality also plays an important role in monitoring the sound environment for safety. For example, it is clearly desirable for an individual to be able to use directional perception of tire noise or the like to determine the direction of an approaching vehicle. These issues are of particular importance for a blind individual employing spatial hearing abilities for purposes of navigation.

OBJECTS AND SUMMARY OF THE INVENTION

It is a primary object of the present invention to provide a method and apparatus for transducing sound on a highly directional basis utilizing small and inexpensive microphone elements.

It is an object of the present invention to utilize bidirectional first order gradient microphones in applications where they have not previously been used, as for example: in various types of wearable assistive devices for the hearing impaired who must hear while in noisy environments; in hearing aids of appropriate design; in controlling computers with voice commands where good signal-to-noise ratios are important; and in obtaining very strong spatial separation of sounds for various kinds of assistive listening devices for the hearing impaired and for other populations requiring this ability. In each application good signal to noise ratios and compact equipment size are maintained.

It is another object of the present invention to utilize bipolar microphones in conjunction with appropriate sound shadows, variously implemented, which cooperate with the narrow beam patterns of these microphones to provide better noise rejection characteristics than other first order pressure gradient microphones. In addition, it is an object of the invention to utilize the superior noise rejection capabilities of bipolar microphones to enhance perception of spatial separation among sound sources positioned in different directions with respect to the microphone.

It is a further object of this invention to provide a method and apparatus for using bipolar microphones wherein the rear facing lobe can be attenuated, or otherwise functionally decreased, by means of an intervening sound shadow such as the wearer's body or head, a wall or other object.

A still further object of the invention is to take advantage of the discovery that rear located low frequency sources of sound, with wavelengths longer than the dimensions of a rear located object casting a sound shadow, can be attenuated for a bipolar microphone, but not for any other type of first order directional microphone, by means of appropriate geometry of the rear located object, such that microphone output signals resulting from all rear located sound sources can be decreased with resulting improvement in the output signal-to-noise ratio, regardless of the frequency of the signal from the rear located signal source and even though the size of the sound shadow is smaller than the wavelength of the sound.

It is another object of the present invention to decrease the effective gain of the rear facing lobe of bipolar microphones to achieve consequent improvement in signal-to-noise ratios for a variety of applications.

Another object of the invention is to provide a high degree of directional discrimination between sound signals and ambient noise, while eliminating microphone case noise and the like, using two cardioid microphones mounted on a common structure to face opposite directions.

In accordance with one aspect of the invention a first order bipolar microphone is employed with a rear sound shadow structure to suppress the output level from rearwardly arriving acoustic energy. An important factor in this aspect of the invention is my discovery that a sound shadow structure disposed at the rear of a first order bidirectional microphone causes acoustic energy directed from the rear to appear to be arriving along a path substantially perpendicular to the main or forward-rearward axis of the microphone. Importantly, this phenomenon is largely independent of frequency. Since energy arriving perpendicular to the main axis is heavily attenuated, and since the main forward lobe of the polar gain plot exhibits a relatively rapid decrease in any angular direction away from 0°, the result is a unidirectional microphone having a high degree of spatial selectivity.

The sound shadow structure may take a variety of forms including the human body in a body-worn hearing assistive device. Microphones may also be mounted on eyeglass frames and thereby utilize the sound shadow provided by the wearer's head. A pen-like unit may also carry a microphone and utilize the sound shadow effect of the user's body when clipped in a shirt pocket or handheld. Alternatively, a wall or other physical structure may be mounted to the rear of the microphone to serve in various applications where unidirectional reception of acoustic energy is desired. One such application is a speech responsive machine such as a speech recognition system, intended to operate in a noisy ambient environment.

In another aspect of the present invention, a bipolar pattern is obtained by mounting two cardioid microphones rigidly together and facing opposite directions. A differential amplifier or the like is used to subtract the output signal of the rearward facing microphone from the output signal of the forward facing microphone to obtain a highly directional overall response. An advantage of the arrangement is that the case noise is inherently minimized since the common mounting causes both microphones to experience identical vibrations that cancel one another in the differential amplifier.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein like reference numerals in the various figures are utilized to designate like components, and wherein:

FIG. 7*b* is a front view of the combination of FIG. 7*a;*

DESCRIPTION OF THE PREFERRED EMBODIMENT

Figure 1A:
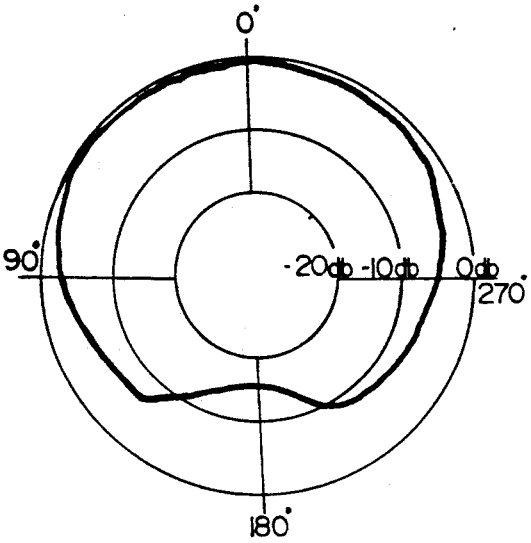
FIG. 1*a* is a two dimensional polar plot of a typical cardioid microphone response to wideband noise.

The present invention takes advantage of the desirable characteristic of first order bipolar microphones whereby the front facing lobe, usually taken to be that portion of the lobe pattern at and around 0° as depicted in polar response plots, decreases rapidly in gain in any angular direction away from 0°, thereby resulting in rapid decrease in output signal from off-axis acoustic energy sources. For reference, the decrease in output level for a bipolar microphone as compared to a first order cardioid is: at +/−45°, 6 db for the bipolar and less than 1 db for the cardioid; at +/−90°, approximately 20 db for the bipolar and 6 db for the cardioid. In contrast, an undesirable characteristic of the bipolar microphone is that the rear facing lobe, usually taken to be at and around 180° as depicted in polar plots, has the same gain characteristic as the front facing lobe. For reference, the cardioid decrease in gain as a function of angle is about 14 db at +/−135° and greater than 20 db at 180°, while the bipolar microphone decrease in gain as a function of angle is 6 db at +/−135° and 0 db at 180°, or some approximation of these attenuations depending on design details. The present invention, by using sound shadows to suppress the output level from the rear facing lobe of a bipolar microphone, provides superior overall noise rejection as compared to the cardioid microphone.

In addition, the more rapid fall-off of the gain pattern for the bipolar microphone about 0° is advantageous for some applications. In this regard, consider the noise-to-signal ratio expressed in db for both the bipolar and the cardioid microphone types with and without rear lobe suppression. Without rear lobe suppression the bipolar microphone has a rating of 4.7 db and the cardioid microphone a rating of 4.7 db. With rear lobe suppression, the bipolar microphone has a rating of 7.7 db and the cardioid microphone in essence does not change at all since very little noise energy is received by the cardioid microphone from the rear direction. Hence, if the rear lobe energy received by a bipolar microphone is suppressed as described herein, the bipolar microphone becomes more noise resistant than the cardioid microphone by a factor of 3 db, a very significant improvement in signal-to-noise ratio.

It is well known and can be shown by measurements taken under anechoic conditions that the effect of a person's body shadow on sound sources located to the rear of the body, when a microphone is located at the front of the body, is to highly attenuate (e.g., on the order of 10 db or more) the rearwardly received energy, irrespective of the type of microphone, provided the signal frequencies are such as to have wavelengths smaller than the smallest cross-sectional dimension of the body. What is not appreciated in the prior art, however, is that if the microphone beam pattern is that of a bidirectional microphone type, with very low gain at 90° to the main axis of gain as is characteristic of bipolar microphones, the suppression by sound shadow of energy arriving from the rear is largely independent of frequency and, therefore, of wavelength. This is uniquely true for bipolar first order microphones, but not true for cardioid and other first order pressure gradient microphones.

To make this discovery more clearly understandable, consider the following. The wavelength of a 1000 Hz acoustic signal is approximately one foot and the wavelength of a 100 Hz signal is approximately ten feet. Since the smallest body dimension in the midsection region of a typical person's body is between twelve and sixteen inches, one would expect frequencies at and above 1000 Hz to be attenuated by the body shadow since they cannot diffract around bodies as large or larger than a wavelength. One would also expect that frequencies much below 1000 Hz would not be attenuated because they would diffract around the body and thus excite the microphone element. However, I have found that for bidirectional elements, but not for cardioid microphones or for omnidirectional microphones, significant signal attenuation is obtained for rearwardly arriving signals down to at least 100 Hz even though the wavelengths are much longer than sixteen inches. This occurs because the body shadow causes an apparent change of direction of arrival of the rear sound signal, making it appear to the microphone as though the signal arrives from an angle of very nearly at 90° even though diffraction effects prevent actual attenuation from occurring. Since bidirectional elements have very low gain responses at and near 90°, the net effect is significant attenuation of rearwardly arriving signals. In contrast, since cardioid microphones and omnidirectional microphones have large lobe gains at and around 90°, the net effect of body shadow is to increase the gain for rearwardly arriving signals for those microphone types.

An important aspect of using this discovery is the proximity to 90° of the apparent angle of arrival of rearwardly received signals. Typical values of gain as a function of reception angle, referenced to 0db main lobe maximum gain, are as follows: bipolar microphone gain at +/−90° is less than −20 db; at +/−102.25°, gain is −7 db; and at +/−112.5°, gain is −4 db. Hence, to attain maximum advantage from the effect and achieve maximum noise reduction, it is desirable that the apparent angle of arrival of the signal be as close to 90° as possible. The configuration of an effective barrier to create the desired sound shadow can be easily calculated in terms of deviation of the effective angle of arrival of a signal if the dimensions of the bipolar element are known. For example, a typical electret bipolar microphone measures one-half inch in diameter with a spacing of one-quarter inch between front and back ports. Consider now a circular barrier of two and one-half inches in radius spaced one-quarter inch behind the rear ports of the element, with the circle centered on and perpendicular to the 180° axis of the microphone. This arrangement results in an effective angle of arrival of the rearward signal of about 99°, providing an attenuation for rearwardly arriving signals of slightly better than 7 db. It is assumed that a flat surface perpendicular to the axis of the microphone is used for the barrier. In general flat surfaces or surfaces with curvature away from the microphone (i.e., concave to the rearwardly arriving sound) should be used so as to not extend forwardly along the microphone and thereby block or interfere with noise signals actually arriving directly at and around 90° where gain is at a minimum.

It is clear from the foregoing that surfaces larger than five inches in their smallest dimension transverse to the microphone 180° axis, such as the human body, provide even larger attenuations of rearwardly arriving signals. In fact, for a chest-mounted bidirectional microphone the effective attenuation of the rearwardly arriving signal under anechoic conditions is found to be in excess of 10 db when the signal is wideband noise weighted to have spectral energies comparable to speech, and better than 7 db for 250 Hz narrowband noise measured under similar conditions. Similar measurements made with the microphone mounted on the center of a person's forehead show attenuation better than 10 db for wideband noise and better than 7 db for 250 Hz noise. On the other hand, measurements made using either omnidirectional or cardioid microphones in the same manner do not show these improvements for the lower frequencies.

Figure 16:
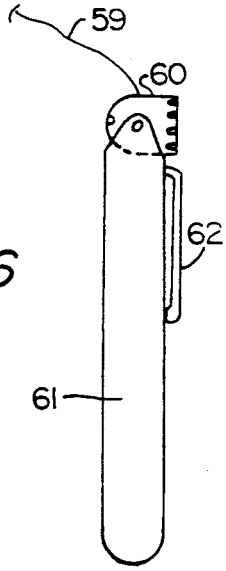
FIG. 16 is a side view in elevation of a pen-like structure having a bipolar microphone mounted thereon.
Figure 17:
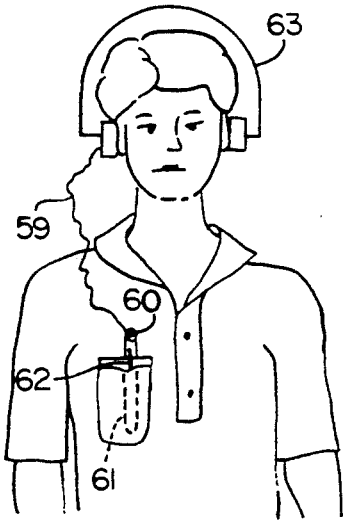
FIG. 17 is a diagram of the structure of FIG. 16 employed in connection with a head set.

Many applications benefit from the central idea of using bidirectional first order microphones and body shadow or sound shadows obtained by other means, to obtain improved noise immunity and directionality. One such application, as described below in relation to FIGS. 16 and 17, is a single bidirectional microphone mounted in a pen shaped object or some other conveniently shaped package with supporting electronics, battery and interconnection system. The result is a small compact directional microphone with appropriate amplifying electronics, power source and interconnect mechanism for enabling a hearing impaired person to hear better in the presence of noise.

A characteristic problem for prior art assistive listening devices is that feedback between the typical headset or earbuds and the microphone causes whistling sounds if the gain is turned-up too high. This usually occurs before adequate volume levels for an impaired hearing user are reached. An additional advantage of the bidirectional microphone used in accordance with the present invention is that this feedback is reduced significantly for conventional headsets and/or earbuds because of the low microphone gain at and around +/−90°.

In another embodiment of the invention a single bidirectional microphone, along with appropriate electronics and interfacing mechanisms, contains as part of its packaging a rear mounted acoustically opaque disk and an appropriate mounting mechanism such as a desk stand. In operation this microphone assembly is placed on a surface with the forward direction along the 0°-axis facing a user while the rear 180° direction is masked by the rear mounted disk. The described structure provides a narrow beam microphone with good noise rejection for use in applications where good signal-to-noise ratios are required. One application for this configuration is speech controlled computer systems.

A further embodiment of the invention pertains to assistive listening devices and utilizes a pair of bidirectional microphones mounted at +/−45° to the forward direction on a small case worn on the chest of a user. Also within the case are the required supportive electronics, battery and output coupling system. This arrangement enables binaural hearing with good spatial representation of the position of sound sources. The amplification system and the output coupling mechanism used to couple the amplified signals to the ears are stereo in nature. It is important, even with a chest-mounted location of the microphones, that the spatial separation is greater than with normal hearing to thereby enhance spatial separation of sound events and likewise enhance the perception of motion of moving sound events. As discussed above, good spatial separation of sound events helps listening in the presence of noise by as much as 4 db as compared to binaural aiding that lacks true stereo (i.e., spatial) information. As likewise mentioned above, this system and the embodiment described below serve as valuable navigation aids for blind individuals.

A further embodiment of bidirectional gradient microphones according to the present invention pertains to a hearing aid type device. In this embodiment, which is similar to a conventional eyeglass hearing aid set except for the microphones, two microphone elements are located near the intersection of the temples and eyeglass frames. For best back-masking by head shadow of the undesired rear facing microphone gain lobe, the microphone elements are mounted somewhat more forward than in conventional eyeglass hearing aids, and they are aimed more or less perpendicular to the plane of the frame at the location site. Since the forward gain lobes of the microphones have narrow reception patterns, the desired noise immunity and directionality are maintained. As in the case of the previously described embodiment, binaural-spatial hearing is maintained by use of separate electronics and ear receivers for each microphone.

It has also been found that two cardioid microphones rigidly mounted together to face in opposite directions can provide a highly directive response pattern if their output signals are combined differentially. The microphones are mounted so that both microphones experience the same case vibrations, whereby the resulting noise effects are canceled when the output signals are differentially combined.

It should be understood that the described embodiments are provided as examples only and are not meant to represent the only uses of the invention.

Figure 1B:
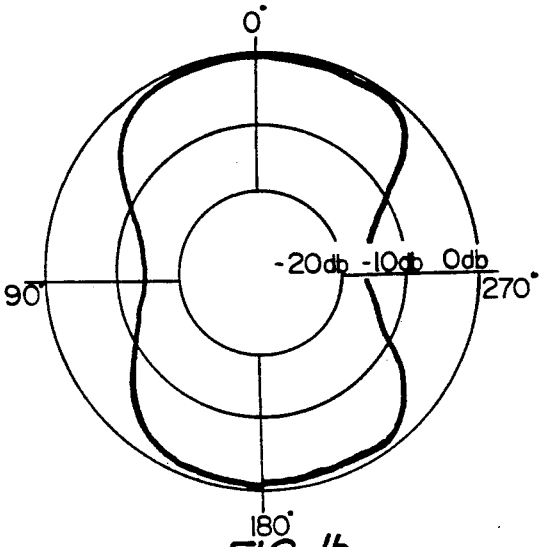
FIG. 1*b* is a two dimensional polar plot of a typical bipolar microphone response to wideband noise.

Referring specifically to FIG. 1*a* of the accompanying drawings, a two dimensional polar plot depicts a typical cardioid microphone response pattern measured in free space (anechoic chamber) using a wideband noise sound source weighted to approximate the speech spectrum. The ideal directivity of this microphone type is 4.7 db. Since the pattern shown is not ideal, the null at 180° is only partial but still better than −15 db. In FIG. 1*b* a similar response pattern measured for a bidirectional microphone is depicted. Note that although the nulls at +/−90° are not total, they are on the order of −15 db and considerably below the +/−90° response in FIG. 1*a*. The directivity of an ideal bidirectional microphone is 6 db.

Figure 2A:
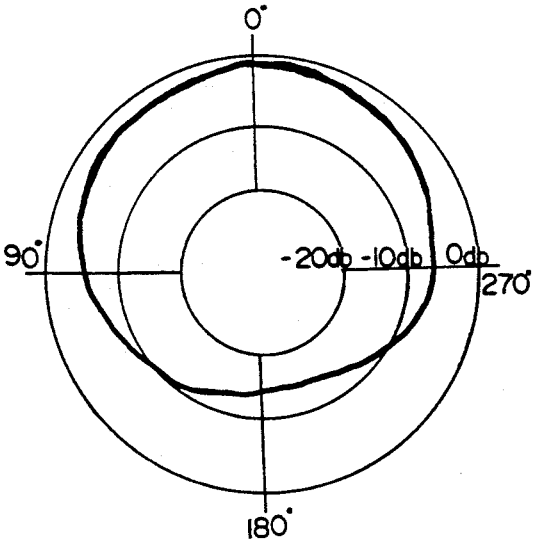
FIG. 2*a* is a two dimensional polar plot of a cardioid microphone response to wideband noise measured when the microphone is mounted facing forward on the chest of an individual.
Figure 2B:
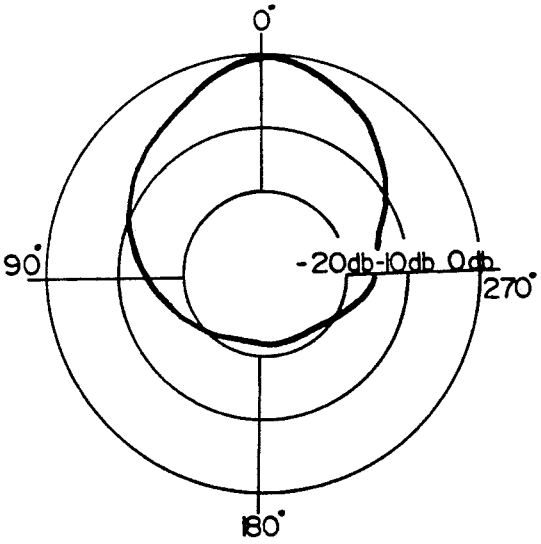
FIG. 2*b* is a two-dimensional polar plot of a bipolar microphone response to wideband noise measured when the microphone is mounted facing forward on the chest of an individual.

Referring now to FIG. 2*a*, there is illustrated a two-dimensional polar plot of a response for a cardioid microphone mounted on the chest of an individual and facing in the forward direction. The measurement is made in an anechoic chamber with wideband noise weighted to approximate speech. It is noted that the back lobe suppression is somewhat degraded compared to the plot in FIG. 1*a*, but that the remainder of the pattern remains about the same. In FIG. 2*b* a similar response pattern is depicted except that the cardioid microphone is replaced with a bidirectional microphone likewise facing in the forward direction and again measured with speech weighted wideband noise. Of particular note is the slightly better back lobe suppression than shown in FIG. 2*a* (i.e., down beyond −20 db) and the significantly reduced side lobe gain from that shown in FIG. 1*b*. This highly desirable effect appears to be due to interaction of reflected waves from the masking or shadow body with the directly received wave. The suppression at +/−90° is reduced to about −12 db from about −16 db as compared to FIG. 1*b*.

Figure 3A:
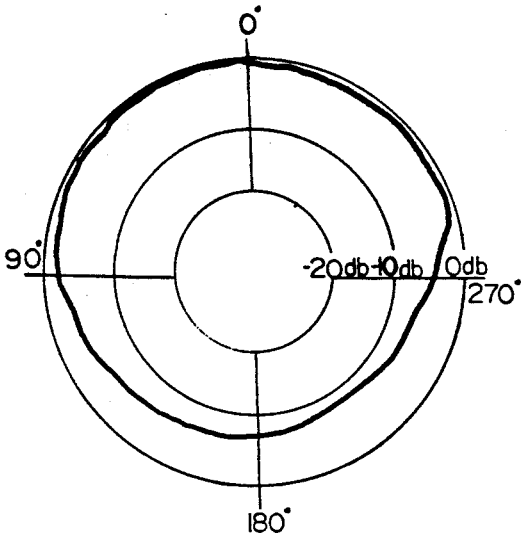
FIG. 3*a* is a two-dimensional polar plot of a chest-mounted cardioid microphone response to narrowband noise centered at 250 Hz.
Figure 3B:
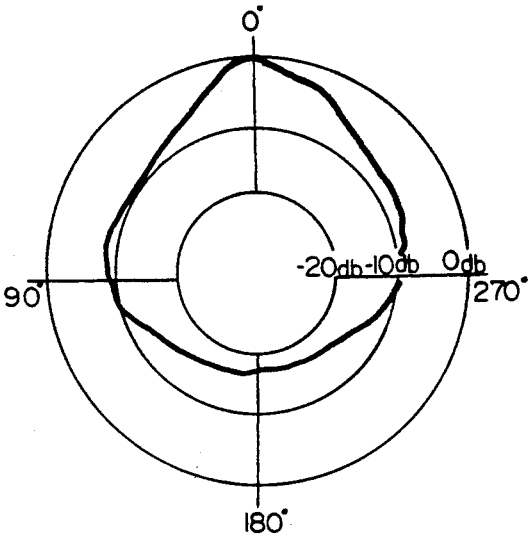
FIG. 3*b* is a two-dimensional polar plot of a chest-mounted bidirectional microphone response to narrowband noise centered at 250 Hz.

FIGS. 3*a* and 3*b* illustrate the results of narrowband noise measurements taken on two microphone types, one being a chest-mounted cardioid microphone (FIG. 3*a*), the other being the chest-mounted bidirectional microphone (FIG. 3*b*). The measurements and the configurations employed are the same as in FIGS. 2*a* and 2*b*, respectively, but the test signal is narrowband noise centered at 250 Hz. In FIG. 3*a* the back lobe suppression for 250 Hz noise has been reduced for the cardioid microphone to about −8 db as compared to about −14 db as shown in FIG. 2*a* for wideband noise. In FIG. 3*b* the back lobe suppression for the bidirectional microphone has been likewise reduced as compared to the better than −20 db shown in FIG. 2*b*, but is still better than −15 db.

Figure 4A:
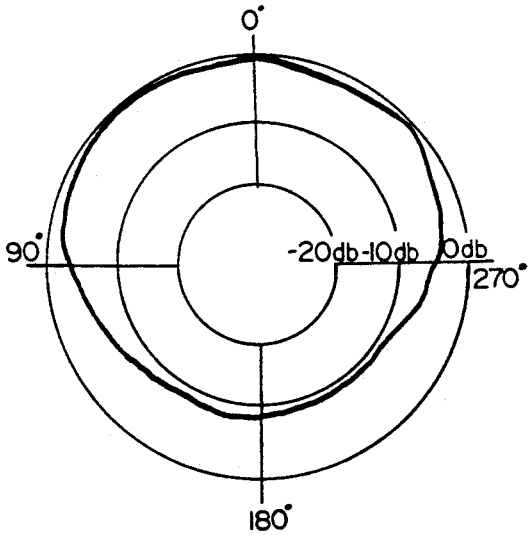
FIG. 4*a* is a two-dimensional polar plot of a forward facing head-mounted cardioid microphone response to wideband noise.
Figure 4B:
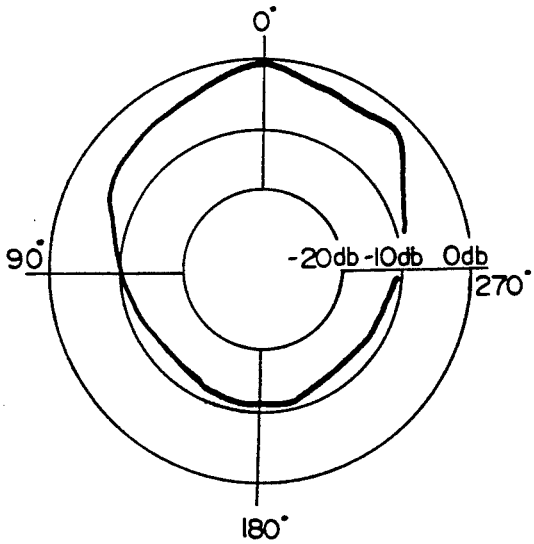
FIG. 4*b* is a two-dimensional polar plot of a forward facing head-mounted bidirectional microphone to wideband noise.

FIGS. 4*a* and 4*b* illustrate similar measurements to those shown in FIGS. 2*a* and 2*b*, taken on a cardioid microphone and a bidirectional microphone, respectively, except that the microphone are worn on an individual's head. In FIG. 4*a* the cardioid microphone response pattern to speech weighted wideband noise shows the back lobe suppression reduced from the free-field condition to about −9 db. In FIG. 4*b*, again responsive to speech weighted wideband noise, the clear advantage of the bidirectional microphone over the cardioid is evident in the better side lobe and rear lobe suppression.

I have found that if a flat circular disk of substantially opaque acoustical properties is placed to the rear and normal to the axis of a bidirectional first order microphone, substantial reduction occurs in the response of the microphone to signals arriving from the rear direction. Substantial reduction in gain also occurs for signals arriving within the solid angle of 90° about the 180°-axis. While the use of an absorptive surface on the face of the disk may be implemented, no significant difference in performance is observed. However, other dimensional parameters regarding the relationship between the disk and the microphone and the size of the disk are significant.

In particular, in order to obtain optimum attenuation of rearwardly received signals, the spacing between the microphone and the disk must be such that, at one extreme, little or no undesirable interaction occurs between the rear ports of the microphone and the opaque disk or plate. On the other hand, the acoustic action caused by the opaque plate must be such as to obtain the desired effect of attenuation. It has been found experimentally that, for a circular opaque plate six inches in diameter, with or without absorptive coating, the minimum effective spacing is about 0.4 inch and the maximum effective spacing is about one inch, the optimum distance being between 0.5 inch and 0.6 inch. For larger sized intervening objects the closest acceptable spacing is not affected, remaining at about 0.4 inch minimum, but the maximum spacing affording adequate attenuation increases roughly in accordance with the size of the intervening object. Thus, measurements of rear attenuation taken using an adult body as the intervening object, wherein the bidirectional microphone is located in front of the chest having a minimum dimension of about twelve inches, show that the maximum effective distance between the chest and the back of the microphone is, approximately, at least 0.4 inch and not more than about 3.0 inches.

The attenuation obtained as described above does not increase substantially for objects larger than six inches but instead only allow greater spacing between the microphone and the disk. However, if the disk size is substantially less than about five inches, the attenuation afforded is found to decrease in magnitude, although lower attenuation may be adequate for some purposes.

An important characteristic of this invention is that, although the dimensions cited above for the aforesaid disks are small compared to the lower frequency sound components of interest, the desired attenuation is first order not affected by the frequency of the signals arriving from the rear direction. That is, the desired attenuation appears for signal frequency components as low as 100 Hz as well as for the components of shorter wavelengths such as at 10,000 Hz and higher. This is in contradiction to the usual case for signal attenuation wherein the smallest dimension of the masking object must be larger than the wavelength of the signal to be masked. The reason for this anomalous behavior is that the apparent direction of arrival of the rear signals (i.e., derived from a source directed exactly normal to the disk) is from the side at approximately 90° to the source where, uniquely for a bidirectional microphone but for no other first order type, the microphone response is at a minimum. Indeed, if the field intensity is measured on both surfaces of the disk using an omni-microphone probe, it is found that it is almost (but not exactly) constant as though the disk is not present. However, if relative phase measurements are made in the same region about the disk, it is found that the relative phases of the signals are radically different from similar measurements made without the disk in place. For the region in front of the disk (i.e., the side facing away from direction of arrival of the rear signal), the phase distribution corresponds to that of in-phase signals arriving symmetrically from the sides, above and below the disk, all sources being at 90° to the axis of the microphone and thus parallel to the plane of the disk.

There is another anomaly appearing in the response of the microphone for the indicated geometry. Specifically, if the microphone is located exactly on axis of a circular disk, it is found that the attenuation decreases abruptly by some amount when the disk and microphone combination are exactly normal to the direction of arrival of the rear undesired signal. This decrease in desired attenuation is relative to the disk and microphone assembly oriented at some angle nearly normal, but not exactly normal, to the direction of signal arrival. To make this clearer, by nearly normal is meant a deviation on the order of approximately 10° from normal. The observed decrease in desired attenuation can be as much as 10 db in some cases which is, for the methods described herein, not desirable. This effect can be almost entirely removed by displacing the microphone by approximately 0.5 inch to 1.0 inch, in the case of a six inch diameter disk, in any direction away from the axis (i.e., the disk center) while maintaining the axis of the microphone still normal to the plane of the disk. This positioning is illustrated in FIGS. 5*a* and 5*b*.

Figure 5A:
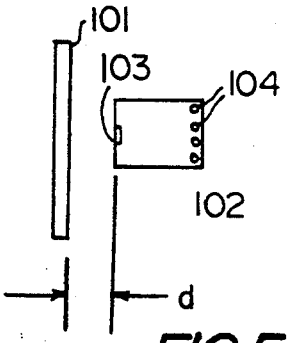
FIG. 5*a* is a diagrammatic side view of a bipolar microphone and sound shadow structure illustrating the principles of the present invention.
Figure 5B:
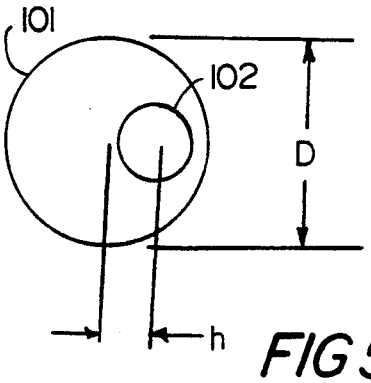
FIG. 5*b* is a diagrammatic view of the microphone and sound shadow structure of FIG. 5*a;*

Referring to FIGS. 5*a* and 5*b*, a circular disk 101 is spaced a distance d behind a bipolar microphone 102. The microphone may be any model bidirectional microphone of the type described, a particular embodiment of which is sold commercially as model EM-83B.15 by Primo Microphones, Inc. of McKinney, Tex. This microphone has a diameter on the order of 10 mm (0.39 inch) and a length on the order of 12 mm (0.47 inch). The disk 101 has a diameter D, and the microphone 0°-axis is normal to the disk but laterally displaced from the disk center by the distance h. The distance h is selected such that the entire microphone is within the sound shadow created by the disk and not directly exposed to rearwardly received sound. The forward ports of microphone 102 are designated by the reference numeral 104.

The reason for the improved attenuation when the disk 101 is off axis is that the spatial phase gradient apparently is a maximum along a normal line drawn through the center of a circular disk 101 when the disk is perpendicular to the direction of arrival of a sound wave. For the same disk in the same orientation with respect to the sound signal, the spatial phase gradient decreases rapidly along lines drawn normal to the disk but displaced from the symmetric center. However, as shown by measurements, as the normal lines are moved still further away from the center, nearing an edge of the disk, the phase gradient increases again, reaching a new and even higher maximum as it passes from behind the disk entirely.

The effect of decreased attenuation when the microphone 102 is placed along the center normal line of the disk 101 is generally not desirable. However, if maximum attenuation is desired except when the front of the microphone is facing towards the sound source, or at small angles away from the sound source, there are some situations where the very narrow angular lobe patterns (typically less than 10° between −6 db gain suppressions relative to the maximum lobe gain) derived this way might be believed to be of value in conjunction with other means for suppressing microphone responses due to signals arriving from other directions; in fact this does not appear to be the case. The reasons for this are that this reverse direction maximum peak response is found to be on the order of 10 db below the main forward lobe response, resulting in poor effective microphone sensitivity, and because no shielding method has been found that decreases other direction responses without adversely affecting the desired reverse direction peak response as well.

As will be well appreciated, the specific dimensions discussed above may require modification, either to be larger or smaller, depending on the acoustical frequencies of interest and on the physical size of the microphone element in question. In the above discussion, the bidirectional microphone element used is on the order of 10 mm in diameter and 12 mm in length and, without departing from the principles of the invention, the disk sizes and shapes may be varied according to practical considerations with results verified by experimental methods. In particular, it is within the scope of the invention that an intervening shape other than a circular flat disk, such as a curved surface or three dimensional volume, such as the chest of a person may be used.

In the embodiment illustrated in FIGS. 5*a* and 5*b*, a typical set of dimensions are: D=6 inches; d is in the range of 0.5 to 0.8 inch; and h is in the range of 0.5 to 1.0 inch. If the microphone 102 is used in conjunction with body worn equipment, such as an assistive listening device for the deaf (ALD), wherein the microphone is worn facing forward in the region of the chest, the disk is eliminated since the interposed body serves its function. In this latter case, offsetting the microphone 102 from the center of the chest is not critical since the larger size of the intervening body, as compared to a six inch diameter disk, makes the aforementioned loss of attenuation for perpendicularly arriving rear waves insignificant. It is understood, of course, that FIGS. 5*a* and 5*b* are only diagrammatic representations and that disk 101 is typically supported in fixed position relative to microphone 102 by structure that is not shown.

TABLE I

| Source Angle | D d h | (1) No Disk | (2) 6" 0.5" 0.5" | (3) 6" 0.25" 0.5" | (4) 4" 0.25" 0 | (5) 6" 0.5" 0 |
|---|---|---|---|---|---|---|
| 0° | | 0 db | 0 db | 0 db | 0 db | — |
| 45° | | −5 db | −6.5 db | −7 db | −5.5 db | — |
| 90° | | −13 db | −15.5 db | −9.5 db | −8 db | −11 db |
| 135° | | −5 db | −21.5 db | −18.5 db | −11.5 db | −22 db |
| 158° | | — | — | — | — | −21 db |
| 180° | | −2 db | −16.5 db | −20.5 db | −7.5 db | −10 db |
| 202° | | — | — | — | — | −21 db |
| 225° | | −6 db | −21.5 db | −18.5 db | −11.5 db | −21 db |
| 270° | | −12 db | −16.5 db | −9.5 db | −7.5 db | −11 db |
| 315° | | −2 db | −7.5 db | −5.5 db | −5 db | — |

Table I presents the results of five different sets of measurements made with the apparatus of FIGS. 5*a* and 5*b* to demonstrate responses using circular disks 101 of various diameters D located at different spacings h from the rear of the microphone 102. In each measurement set the acoustic energy was provided by a wideband noise source, filtered to approximate weighted speech, through an array of speakers configured to generate a planar wave front. The speakers were placed six feet from the microphone and disk which were rotated, relative to the source wavefront, to the angles specified in the Table for each measurement. All attenuation measurements are shown relative to the 0°-axis reading, taken as 0 db for each measurement set.

In measurement set (1) there was no disk employed in order to provide the basis for comparison with the other measurement sets. Measurement set (5) differs from sets (2), (3) and (4) in that only the rear lobe response was measured. It is clear that the best results are obtained in measurement sets (2) and (3) wherein the disk center was displaced off-axis from the microphone axis. The greater spacing d between measurement (3) and (2) also shows improved attenuation of the rearwardly received signal.

When utilizing bidirectional microphones it is generally desirable to mount the microphone element in a housing configured to render it more resistant to mechanical stress, vibration and wind noise. For ease of manufacture it is common to utilize a molded case or some similarly constructed housing. I have found, however, that unless considerable care is taken in selecting the details of the casing design, the desired directionality produced by the rear sound shadow structure can be severely compromised, particularly at frequencies below 1000 Hz. This may be illustrated by considering the embodiments illustrated in FIGS. 6*a* and 6*b*, 7*a* and 7*b*, and 8*a* and 8*b*.

Figure 6A:
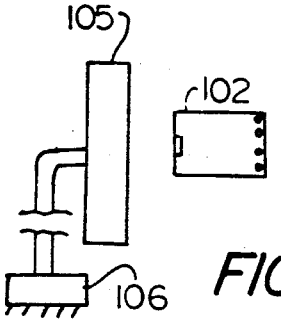
FIG. 6*a* is a diagrammatic side view of a bipolar microphone and another sound shadow structure illustrating the principles of the invention.
Figure 6B:
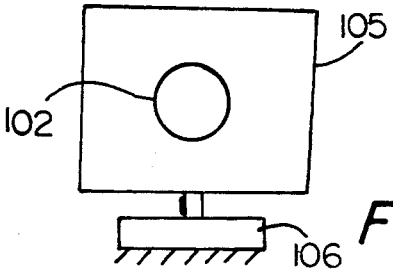
FIG. 6*b* is a diagrammatic front view of the combination of FIG. 6*a;*
Figure 7A:
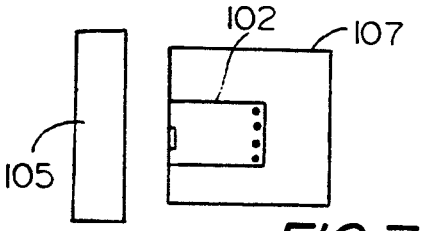
FIG. 7*a* is a diagrammatic side view of the combination of FIG. 6*a* with a tube surrounding the microphone.
Figure 8A:
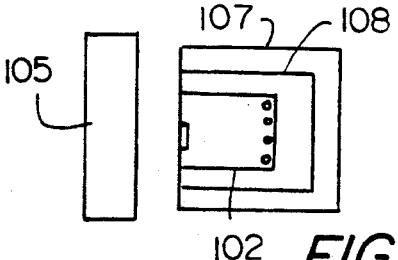
FIG. 8*a* is a diagrammatic side view of the combination of FIG. 7*a* with a second tube interposed between the microphone and the first tube.
Figure 8B:
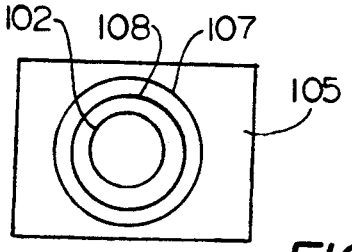
FIG. 8*b* is a diagrammatic front view of the combination of FIG. 8*a;*

Referring specifically to FIGS. 6*a* and 6*b*, microphone 102 is shown disposed in front of a rear barrier 105 mounted on a base 106 placed on a floor, table or other supporting surface. Barrier 105 is selected such that all of the dimensions transverse to the microphone axis exceed twelve inches. In FIGS. 7*a* and 7*b* the same microphone 102 and barrier 105 are employed but the microphone is anularly spaced from and concentrically surrounded by a hollow tube 107. In the test described herein, tube 107 has an internal diameter of 0.85 inch and an axial length of 0.65". The rearward end of tube 107 is coplanar with the rearward end of microphone 102; the forward end of tube 107 projects forwardly of the forward of the microphone. The same structure shown in FIGS. 7*a* and 7*b* is also shown in FIGS. 8*a* and 8*b*, but an additional tube 108 is interposed concentrically between microphone 102 and outer tube 107. Tube 108 is radially spaced from both the microphone and tube 107, has its rearward end coplanar with the rearward ends of the microphone and tube 107, and has its forward end terminating at an axial location intermediate the forward ends of microphone 102 and tube 107.

Table II represents the results measured using a sound source delivering an acoustic signal at a frequency of 250 Hz and received by the microphone assemblies of FIGS. 6*a*, 7*a* and 8*a* at the indicated angles. All measured gain levels are reference to 0 db at the 0°-axis.

TABLE II

| Source Angle | FIG. 6a | FIG. 7a | FIG. 8a |
|---|---|---|---|
| 0° | 0 db | 0 db | 0 db |
| 45° | −7.0 db | −2.0 db | −2.5 db |
| 90° | −9.0 db | −1.0 db | −10.5 db |
| 135° | −14.0 db | −5.5 db | −14.0 db |
| 180° | −16.0 db | −3.0 db | −14.0 db |
| 225° | −14.0 db | −5.5 db | −14.0 db |
| 270° | −9.0 db | −1.0 db | −10.5 db |
| 315° | −7.0 db | −2.0 db | −2.5 db |

From the test results presented in Table II it will be appreciated that the housings illustrated in FIGS. 7*a* and 8*a* each result in significantly different directionality at low frequencies with the design of FIG. 7*a* being poorer than that of FIG. 8*a*. Further, the designs of FIGS. 7*a* and 8*a* produce a net increase in on-axis microphone sensitivity (i.e., at and around 0°) as compared to the assembly of FIG. 6a. This is due to the greater path difference for sound waves reaching the rear parts as compared to the path length to the front parts. As a general rule this is a desirable result. It will be appreciated that the described dimensions are by way of example only and that variations in dimensions will depend, inter alia, on the dimensions of the microphone. Further, optimal parameters for any given configuration will be determined empirically With respect to the spacing between the microphone and barrier for any given application, optimum unidirectivity for a six inch barrier diameter is obtained with a spacing (h) between 0.5 inch and 1.0 inch. For larger intervening barriers, such as a person's chest, optimum unidirectivity occurs with a spacing (h) from about 0.5 inch to a few inches; however, beyond five or six inches the rear lobe attenuation shows a meaningful fall off.

Figure 9A:
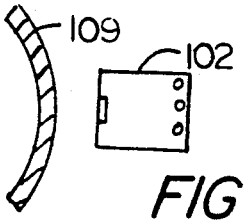
FIG. 9*a* is a diagrammatic side view in partial section showing the bipolar microphone in combination with a curved sound shadow structure.
Figure 9B:
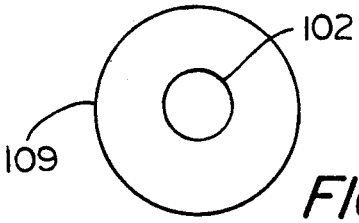
FIG. 9*b* is a diagrammatic front view of the combination of FIG. 9*a;*

FIGS. 9 and 9b illustrate an embodiment wherein microphone 102 is employed in connection with a curved barrier 109. The barrier has a convex surface facing the rear of microphone 102 whereby the barrier curves away from the microphone. This configuration results in a high degree of unidirectivity and represents the principle that the rear barrier can take a variety of shapes and still function pursuant to the invention. It is important, however, that the barrier not curve forwardly to overlap the rear of the microphone and thereby block acoustic energy arriving at 90° and 135° where the attenuation for the bidirectional microphone is maximum.

Figure 10:
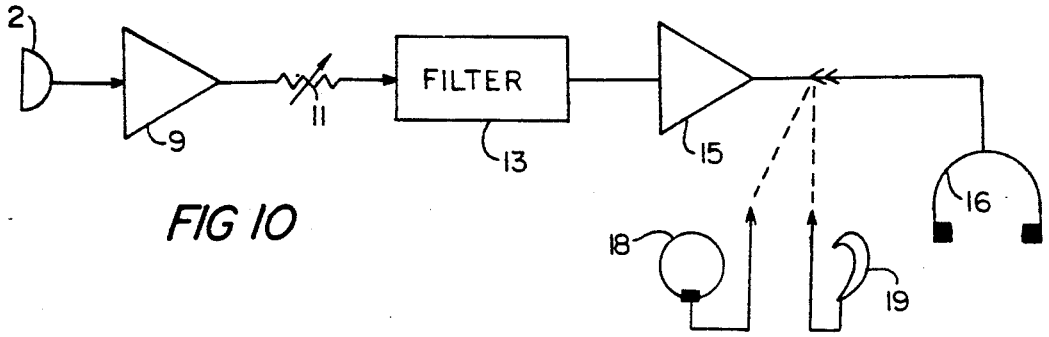
FIG. 10 is a block diagram of a noise-resistant assistive listening device employing a bidirectional microphone according to the present invention.

Referring now to FIG. 10, there is illustrated an assistive listening device using a single bidirectional microphone 2, a preamplifier/amplifier section 9, a gain control 11, filters 13 and an output driver 15. The output signal of the device is shown feeding a headset 16. Alternative output arrangements include, but are not be limited to, an inductive neckloop 18, an inductive ear piece 19, or other means not shown but well known in the art of assistive listening devices.

Figure 11:
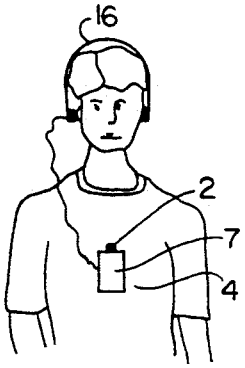
FIG. 11 is a diagram showing the noise-resistant assistive listening device of FIG. 10 in use with a head set.

FIG. 11 depicts an assistive listening device 7, of the type illustrated in FIG. 10, being used with coupling to the ears of an individual via a headset 16. The assistive listening device 7 is worn on the front of the individual's chest 4 such that the substantial part of the upper body of the wearer serves as the rear barrier to suppress the undesired rear lobe of the bidirectional microphone 2.

Figure 12:
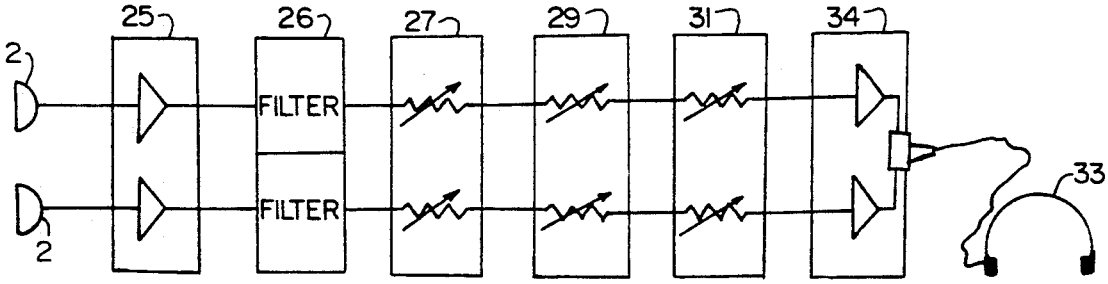
FIG. 12 is a block diagram of a binaural assistive listening device constructed in accordance with the present invention.

Referring now to FIG. 12, a block diagram of a binaural assistive listening device includes two bidirectional microphones 2 feeding respective individual channels comprising a dual preamplifier/amplifier 25, filters 26, dual tone controls 27, commonly adjusted gain controls 29, commonly adjusted balance controls 31, and dual driver stages 34. The output device indicated is a stereo-headset 33. Other means of interconnection to the ear are not specifically illustrated but are well known in the art; these include such means as inductive coupling in the case of hearing aids, etc.

Figure 7A:
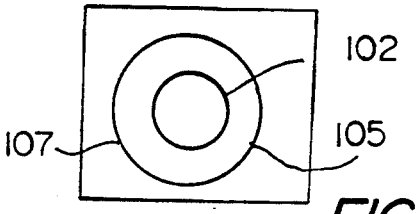
Figure 13A:
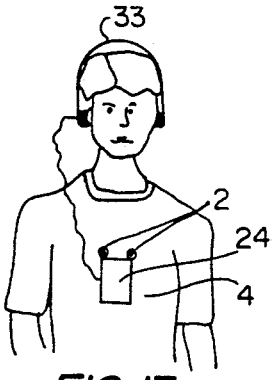
FIGS. 13*a* and 13*b* are diagrams showing the binaural assistive listening device of FIG. 12 in use.
Figure 13B:
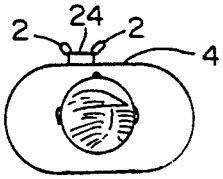

FIGS. 13a and 13b illustrate a binaural device 24 of the type illustrated in FIG. 7. Binaural assistive listening device 24 is worn on the center of the individual's chest 4 as in the case of the monaural version of FIG. 11. The coupling to the ears is via a stereo-headset 33. The two bidirectional microphones 2 are oriented at a 45° angle to the forward direction in order to obtain good spatial separation between sound sources.

Figure 14:
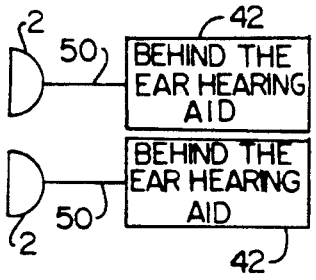
FIG. 14 is a block diagram of an eyeglass hearing aid set using a pair of bidirectional microphones in accordance with the present invention.

Referring now to FIG. 14, a block diagram of a binaural eyeglass hearing aid is shown utilizing two bidirectional microphones to transduce acoustic signals to electorial signals. The two bidirectional microphones 2 feed two conventional behind-the-ear hearing aids 42. By way of explanation, attaching behind-the ear hearing aids to eyeglass temples is the most common method of making eyeglass hearing aids. In the preferred embodiment the wires 50 interconnecting the microphones 2 to the hearing aids 42 also supply power to the microphones.

Figure 15:
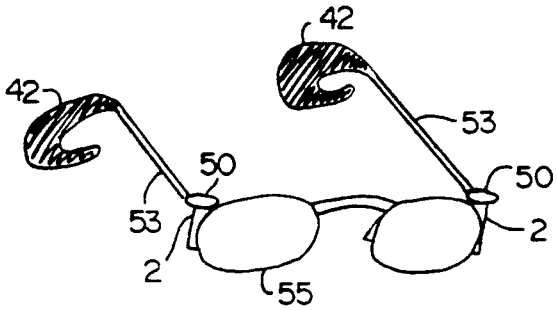
FIG. 15 is a view in perspective of the eyeglass hearing aid set of FIG. 14.

Referring to FIG. 15 a structural arrangement for the eyeglass hearing aid of FIG. 9 includes two conventional behind-the-ear hearing aids 42 mounted at the ear-end of respective eyeglass temples 53. The other ends of the temples are attached to respective ends of eyeglass frame 55. At each end of the upper edge of the eyeglass frame 55 are two respective bidirectional microphones 2 aimed forward and extending slightly outward in a direction corresponding to a perpendicular drawn to the surface of the forehead in line with the locations of the microphones 2 when in use. Wires 50 interconnect the microphones back along or through the temples 53 to the input terminals of the behind-the-ear hearing aids 42.

FIGS. 16 and 17 illustrate a bidirectional microphone 60 mounted atop a pen-like housing or structure 61. The structure 61 preferably includes a pocket clip 62 to permit the unit to be worn in an individual's shirt pocket with the top-mounted microphone exposed and facing forward. Wiring 59 from the unit connects the unit to a headset 63, or the like. Suitable electronic amplifying circuitry and a power supply are disposed in structure 61. The microphone 60 may be mounted to pivot about an axis normal to the length dimension of structure 61, as shown, to permit selective redirection of the 0°-axis of the microphone relative to structure 61. In this embodiment the individual's chest once again serves as the rear barrier producing the sound shadow for rearwardly received sounds. The undesired rear lobe of the microphone is thus suppressed by the individual's body. The device may be either hand-held or worn as shown.

Figure 18:
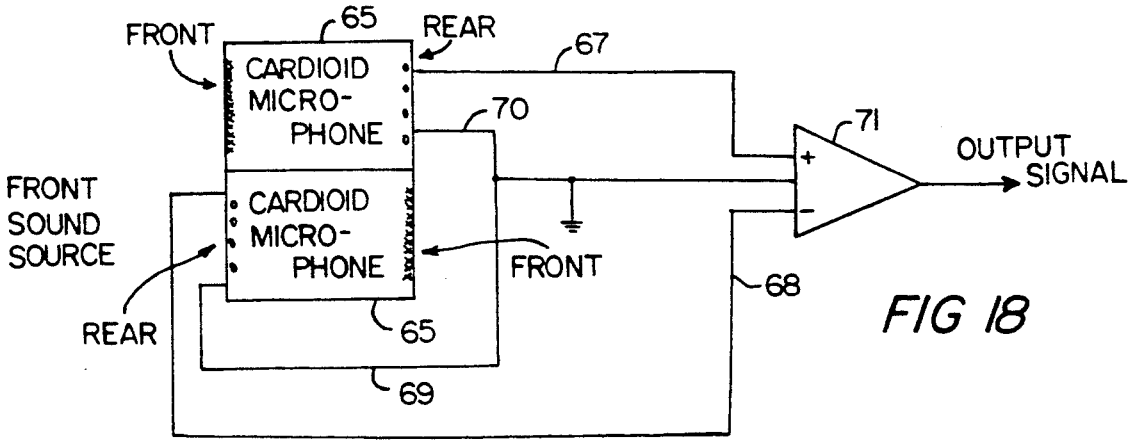
FIG. 18 is a schematic diagram of another embodiment of the present invention employing two oppositely facing cardioid microphones to obtain a unidirectional response pattern.

Referring to FIG. 18, two conventional cardioid microphones 65 are mounted with their adjacent sides in intimate physical contact and with their corresponding ends facing in opposite directions. The microphone output wires 67, 68, 69 and 70 are connected to effect signal subtraction using electronic means such as the positive and negative input terminals of an operational amplifier 71. When this configuration of two cardioid microphones is used, the subtracted signals produce a bipolar pattern response of the type shown in FIG. 1b and described above for a single bidirectional element. However, this two cardioid microphone embodiment has the advantage of lower case noise during actual use because the electronic subtraction in operational amplifier 71 nulls out the mechanical vibration occurring simultaneously in the membranes in the two cases by virtue of the rigid intimate contact between the housings. The essential principle involved in this nulling of case noise is that two motion-sensitive membrane elements are involved, each equally excited by vibrations of the case due to housing vibrations. As will be well appreciated by those skilled in the art, the specific geometry of the arrangement of the two elements and the details of the acoustic pathways, including whether two or more openings are provided for airborne soundwaves, is not of importance so long as the geometry results in a bidirectional pattern. It is well within the state of the art to construct a single microphone capsule containing two membrane elements configured in the manner shown in FIG. 11 or in some similar manner. This resulting structure has all the desirable properties of a bidirectional microphone and the additional advantage of low case noise.

From the forgoing description it will be appreciated that by making available a new application mode for the use of bidirectional microphones in conjunction with body shadow, head shadow, or sound shadows introduced by other means, a new first order gradient microphone of substantially unidirectional characteristics is obtained having superior directivity when compared to all other existing first order microphone types It will also be appreciated that the present invention makes available a improved mounting arrangement for a pair of cardioid microphones whereby differentially combining their output signals results in a unidirectional microphone assembly having negligible case noise.

It will be further appreciated that this invention makes available a means for various classes of individuals to improve their ability to listen to speech in noise and to obtain enhanced spatial sound information under a variety of listening conditions.

Having described a new and novel method and apparatus for obtaining an improved directional first order gradient microphone in conjunction with sound shadows, a new and novel method and apparatus for obtaining improvements in hearing efficiency in noise and for improved spatial perception of sound events, it is believed that other modifications, variations and changes will be suggested to those skilled in the art in view of the teachings forth herein. It is therefor understood that all such variations, modifications and changes are believed to fall in the scope of the present invention as defined by the appended claims.

What is claimed is:

1. The method of converting a bidirectional pressure gradient microphone to a unidirectional microphone comprising the step of establishing a sound shadow for acoustic energy approaching the bidirectional microphone from a rearward direction to change the apparent direction of said approaching acoustic energy to a direction approximately to rearward wherein, the step of establishing includes positioning an acoustically opaque barrier rearwardly of and spaced from said microphone to be intersected by a longitudinal axis of said microphone.

2. The method according to claim 1 wherein said barrier includes a substantially circular surface and wherein said step of positioning said barrier includes placing said barrier with said circular surface facing the rear of said microphone and said longitudinal axis perpendicular to the circular surface and transversely offset from the center of the circular surface.

3. The method according to claim 1 wherein said step of positioning said barrier comprises spacing said barrier from said microphone at a distance in the range between one-quarter inch and six inches.

4. The method according to claim 1 wherein said microphone has a diameter on the order of approximately 0.4 inches and wherein said step of positioning said barrier comprises spacing said barrier from said microphone at a distance in the approximate range of between 0.5 and 0.6 inches.

5. The method according to claim 1 wherein said barrier is a person's body part and wherein said step of positioning said barrier comprises locating said microphone on a supporting member adapted to be worn on said body part, and securing said supporting member in fixed space relation to said body part such that said body part is interposed between said microphone and said acoustic energy approaching the microphone from a rearward direction.

6. The method according to claim 5 further comprising the step of selecting the optimum spacing between said barrier and said microphone on the basis of empirical data to obtain a maximum attenuation of acoustic energy received from rearwardly of said microphone.

7. The method according to claim 1 wherein said step of positioning a barrier includes orienting said barrier such that one surface thereof substantially faces said microphone and is intersected by said longitudinal axis, said surface extending at least five inches in all directions transverse to said longitudinal axis.

8. The method according to claim 7 wherein said step of positioning includes spacing said barrier from said microphone by no less than approximately one-half inch and no more than approximately six inches.

9. A microphone system comprising:

a bipolar microphone having a longitudinal axis extending in a forward direction and a rearward direction, said microphone having a spatial gain characteristic with maximum attenuation for energy received perpendicular to said longitudinal axis; and barrier means disposed rearwardly of and spaced a short distance from said microphone along said longitudinal axis for establishing a sound shadow to change the apparent direction of reception at the microphone of acoustic energy received from rearward of the microphone along said longitudinal axis to a direction approximately perpendicular to said longitudinal axis.

10. The microphone system according to claim 9 wherein said barrier means is an acoustically opaque structural member permanently mounted in fixed spaced relation to said microphone.

11. The microphone system according to claim 10 wherein said short distance is no less than one-half inch, and wherein said barrier extends at least approximately five inches in all directions transverse to said longitudinal axis.

12. The microphone system according to claim 10 wherein said short distance is in the approximate range between one-quarter inch and six inches.

13. The microphone system according to claim 12 wherein said short distance is in the approximate range of between 0.5 and 0.6 inches.

14. The microphone system according to claim 10 wherein said structural member is a circular disk oriented to be substantially perpendicularly intersected by said longitudinal axis at a location displaced from the center of said disk.

15. The microphone system according to claim 14 wherein said location is displaced from the center of said disk by a distance in the approximate range of one-half inch to one inch, and wherein said short distance is in the approximate range of 0.5 inch to 0.8 inch.

16. The microphone system according to claim 10 wherein said barrier means has a forward surface oriented perpendicular to said longitudinal axis.

17. The microphone system according to claim 10 wherein said barrier means has a generally convex forward surface facing said microphone.

18. The microphone system according to claim 9 wherein said barrier means comprises a portion of a person's body, said system further comprising means for attaching said bipolar microphone to said person's body to interpose said body portion between the microphone and acoustic energy approaching said microphone from rearwardly of the microphone.

19. The microphone system according to claim 18 wherein said body portion is a chest and wherein said short distance is in the approximate range of between 0.5 inch and five inches.

20. The microphone system according to claim 19 wherein said means for attaching includes a housing supporting said microphone, and further comprising:

electronic means in said housing for amplifying and filtering audio signals received by said microphone;

speaker means adapted to be supported at an ear of said person; and transmission means for transmitting to said speaker means audio signals amplified and filtered by said electronic means.

21. The microphone system according to claim 20 further comprising a second microphone substantially identical to said bipolar microphone and supported by said housing to allow said chest to create a sound shadow to change the apparent direction of rearward received acoustic energy to a direction substantially perpendicular to the longitudinal axis of said second microphone, wherein said electronic means comprises two channels for amplifying and filtering the audio output signals from said two microphones, respectively, and further comprising: second speaker means adapted to be supported at a second ear of said person; and second transmission means for transmitting amplified and filtered signals from said second channel to said second speaker means; wherein said microphones are spaced horizontally to simulate binaural hearing when said housing is disposed in front of the person's chest.

22. The microphone system according to claim 18 wherein said body portion is a person's head, and wherein said means for attaching is an eyeglass frame assembly.

23. The microphone system according to claim 22 wherein said eyeglass frame assembly includes an eyeglass supporting portion and first and second temple pieces pivotably secured to opposite ends of the supporting portion, and wherein said microphone is secured to said frame assembly.

24. The microphone assembly according to claim 23 further comprising:

a second microphone substantially identical to said bipolar microphone and secured to said eyeglass frame assembly, wherein said bipolar microphone is secured to the frame assembly proximate a junction between said first temple piece and the eyeglass supporting portion, and wherein said second microphone is secured to the frame assembly proximate a junction between the second temple piece and said eyeglass supporting portion, the spacing between and orientation of said microphones being such as to simulate binaural hearing;

and electronic means secured to said eyeglass frame assembly comprising first and second channels for amplifying and filtering audio signals from said bipolar and second microphones, respectively; and first and second speaker means disposed at said first and second ears, respectively of said person for receiving audio signals from said first and second channels, respectively.

25. A microphone system comprising:

a bidirectional microphone having a longitudinal axis extending in a forward direction and a rearward direction, said microphone having a spatial gain characteristic with maximum gain for acoustic energy received from said forward and rearward directions, and maximum attenuation for acoustic energy received from perpendicular to said longitudinal axis; and an acoustically opaque barrier, having a predetermined size transversely of said longitudinal axis and disposed rearwardly of and spaced a short distance from said microphone along said longitudinal axis, for establishing a sound shadow to change the apparent direction of reception at said microphone of acoustical frequency energy received from rearward of the microphone along said longitudinal axis to a direction approximately perpendicular to said longitudinal axis;

wherein said predetermined size is smaller than the wavelength of components in said acoustical frequency energy.

26. The microphone system according to claim 25 wherein said barrier is a structural member mounted in spaced relation to said microphone, wherein said size is in the range of approximately five to sixteen inches in all dimensions transverse to said longitudinal axis, and said short distance is in the approximate range of between one-quarter inch and six inches.

27. A microphone system comprising:

a first order pressure gradient microphone having a longitudinal axis extending in a forward direction and a rearward direction, said microphone having a spatial gain characteristic with minimum gain for acoustic energy received from a direction perpendicular to said longitudinal axis and substantially higher gains for acoustic energy received from said forward and rearward direction; and an acoustically opaque barrier, having a predetermined size transversely of said longitudinal axis and disposed rearwardly and spaced a short distance from said microphone along said longitudinal axis, for establishing a sound shadow to change the apparent direction of reception at said microphone of acoustical frequency energy received from rearward of the microphone along said longitudinal axis to a direction approximately perpendicular to said longitudinal axis;

wherein said predetermined size is smaller than the wave length of components in said acoustical frequency energy.

28. For a first order pressure gradient microphone having a longitudinal axis extending in a forward direction and a rearward direction, and having a spatial gain characteristic with minimum gain for acoustic energy received from perpendicular to said longitudinal axis and substantially higher gain for acoustic energy received from said forward and rearward directions, a method for converting said first order microphone to a unidirectional microphone comprising the step of establishing a sound shadow for acoustic energy approaching the microphone from a rearward direction to change the apparent direction of said approaching acoustic energy to a direction approximately perpendicular to rearward.

29. The method according to claim 28 wherein said step of establishing includes positioning a barrier rearwardly of and spaced from said microphone to be intersected by said longitudinal axis.

* * * * *